US007478956B2

(12) United States Patent
Sanbongi et al.

(10) Patent No.: US 7,478,956 B2
(45) Date of Patent: Jan. 20, 2009

(54) PRINTER FOR PRINTING ON BOTH A HEAT-SENSITIVE ADHESIVE LABEL AND AN ORDINARY LABEL

(75) Inventors: Norimitsu Sanbongi, Chiba (JP); Minoru Hoshino, Chiba (JP); Tatsuya Obuchi, Chiba (JP); Yoshinori Sato, Chiba (JP)

(73) Assignee: Seiko Instruments Inc. (JP)

( * ) Notice: Subject to any disclaimer, the term of this patent is extended or adjusted under 35 U.S.C. 154(b) by 757 days.

(21) Appl. No.: 10/965,120

(22) Filed: Oct. 14, 2004

(65) Prior Publication Data

US 2006/0082637 A1 Apr. 20, 2006

(51) Int. Cl.
*B41J 15/00* (2006.01)

(52) U.S. Cl. ..... 400/611; 400/124.11; 400/621; 226/30; 226/122

(58) Field of Classification Search ..... 400/621, 400/124.11, 611; 399/389; 226/30, 122; 156/DIG. 43, 45
See application file for complete search history.

(56) References Cited

U.S. PATENT DOCUMENTS 5,614,928 A * 3/1997 Matsuda ..... 347/2
5,745,832 A * 4/1998 Yoshiuchi ..... 399/384
5,828,939 A * 10/1998 Yoshiuchi et al. ..... 399/388
6,120,199 A * 9/2000 Takekoshi ..... 400/611
6,647,241 B2 * 11/2003 Harashima ..... 399/389
6,824,264 B2 * 11/2004 Shima et al. ..... 347/102
6,867,792 B2 * 3/2005 Hoshino et al. ..... 347/218
6,947,066 B2 * 9/2005 Sato et al. ..... 347/217
7,025,518 B2 * 4/2006 Hoshino et al. ..... 400/621
7,104,713 B2 * 9/2006 Hoshino et al. ..... 400/621
7,106,354 B2 * 9/2006 Sato et al. ..... 347/171
7,168,870 B2 * 1/2007 Sato et al. ..... 400/120.01
7,213,993 B2 * 5/2007 Takahashi et al. ..... 400/619

* cited by examiner

*Primary Examiner*—Leslie J Evanisko
*Assistant Examiner*—Matthew G Marini
(74) *Attorney, Agent, or Firm*—Adams & Wilks

(57) ABSTRACT

A printer selectively prints on heat-sensitive adhesive sheets and ordinary sheets that have no heat-sensitive adhesive. The printer has a printing unit that prints on one surface of a sheet and a printing platen roller that transports the sheet in a forward direction. A cutter unit cuts the printed sheet to a predetermined length, and a thermal activation unit disposed downstream of the cutter unit has a thermal head for heating the other surface of the sheet and a thermal activation platen roller that transports the sheet in the forward direction. A detector detects whether the sheet is a heat-sensitive adhesive sheet or an ordinary sheet, and a control device controls operation of the thermal activation unit so that both the thermal head and the thermal activation platen roller are operated in response to detection of a heat-sensitive adhesive sheet and so that the thermal activation platen roller but not the thermal head is operated in response to detection of an ordinary sheet.

20 Claims, 8 Drawing Sheets

PRINTER FOR PRINTING ON BOTH A HEAT-SENSITIVE ADHESIVE LABEL AND AN ORDINARY LABEL

BACKGROUND OF THE INVENTION

1. Field of the Invention

The present invention relates to a printer capable of recording on a sheet material having, on one side, a thermally activated adhesive surface which exhibits adhesive strength when heated, and on a sheet material having, on one side, an adhesive surface to which release paper is affixed.

2. Description of the Related Art

In recent years, many of sticker labels used for indication of a bar code, a price, and so on, are of a type having an adhesive layer on a backside of a recording surface (print surface) and stored in a state where a mount or release paper (liner) is affixed thereon for temporary adhesion. However, to use this type of sticker label (hereinafter referred to as an "ordinary label") as a label, it is necessary to peel off the release paper from the adhesive layer, and accordingly, there is a disadvantage in that wastes inevitably occur.

In this connection, as a system which does not require the release paper, there have been developed a heat-sensitive adhesive label having, on a backside of a sheet base, a heat-sensitive adhesive layer which exhibits adhesiveness when heated while usually exhibiting non-adhesiveness, and a thermal activation device for heating the heat-sensitive adhesive layer on the backside of this label.

For example, as the above-mentioned thermal activation device, there have been proposed ones to which a variety of heating systems are applied, the heating systems using, as heating means, a heating roll, a hot air blower, an infrared radiator, an electric heater, a dielectric coil, and the like. Moreover, for example, in JP 11-79152 A (FIG. 1, paragraphs [0024] and [0025]), a technique has been disclosed, which includes bringing, into contact with the heat-sensitive adhesive label, a head having as heat sources a plurality of resistors (heater elements) provided on a ceramic substrate, such as a thermal head for use as a printing head of a thermal printer, thus heating the heat-sensitive adhesive layer.

Here, a conventional general configuration of a printer capable of recording on the heat-sensitive adhesive sheet will be described with reference to a thermal printer P2 of FIG. 10.

The thermal printer P2 of FIG. 10 is composed of a roll housing unit 20 which holds a tape-like heat-sensitive adhesive label 60 wound in a roll shape, a printing unit 30 which prints on the heat-sensitive adhesive label 60, a cutter unit 40 which cuts the heat-sensitive adhesive sheet 60 into labels with a predetermined length, and a thermal activation unit 50 as a thermal activation device which thermally activates a heat-sensitive adhesive layer of the heat-sensitive adhesive label 60. Note that "printing" referred to in this specification includes formation of images of a picture, a pattern, and the like besides those of characters and symbols.

The heat-sensitive adhesive label 60 has a structure in which, for example, a heat insulating layer and a heat-sensitive color-developing layer (printable layer) are formed on a front side of a sheet base, and the heat-sensitive adhesive layer obtained by coating and drying a heat-sensitive adhesive is formed on a backside thereof.

The printing unit 30 is composed of a thermal print head 32 having a plurality of heater elements 31 composed of relatively small resistors arranged in a width direction so as to enable dot printing, a printing platen roller 33 to be brought into press contact with the thermal print head 32 (heater elements 31), and the like. In FIG. 10, the printing platen roller 33 is rotated clockwise, and the heat-sensitive adhesive label 60 is transported to the right side.

The cutter unit 40 is one for cutting the heat-sensitive adhesive label 60 on which printing has been performed by the printing unit 30 into pieces with an appropriate length, and is composed of a movable blade 41 operated by a drive source (not shown) such as an electric motor, a stationary blade 42 opposed to this movable blade, and the like.

The thermal activation unit 50 is composed of a thermal-activation thermal head 52 serving as heating means having heater elements 51, a thermal activation platen roller 53 serving as transporting means for transporting the heat-sensitive adhesive label 60, draw-in rollers 54 which draw the heat-sensitive adhesive label 60 supplied from the printing unit 30 side into between the thermal-activation thermal head 52 (heater elements 51) and the thermal activation platen roller 53. In FIG. 10, the thermal activation platen roller 53 is rotated in a direction reverse to a rotation direction of the printing platen roller 33 (counterclockwise in the drawing) and transports the heat-sensitive adhesive label 60 to a predetermined direction (right side).

Note that, because a wrinkle becomes apt to occur in the heat-sensitive adhesive label or a transport failure becomes apt to occur when the label sags while being transported, generally, transport speed (print speed) by the above-described printing platen roller 33 and transport speed (activation speed) by the above-described thermal activation platen roller 53 are set equal to each other.

According to the thermal printer P2 thus configured, once the adhesiveness of the heat-sensitive adhesive label 60 is exhibited, sticking of an indicator label on a corrugated cardboard, a clear plastic wrap, a glass bottle, a plastic container, or the like, or sticking of a price or advertisement label can be directly performed. Accordingly, the thermal printer P2 has an advantage in that such release paper used for the ordinary label becomes unnecessary to make it possible to reduce cost. Moreover, the release paper turning to the wastes after usage is not required, and accordingly, the thermal printer P2 is desirable also from the viewpoints of resource savings and environmental protection.

Incidentally, in the printer P2 as shown in FIG. 10, when the cutting operation by the cutter unit 40 is performed, it has been necessary to stop the transport of the heat-sensitive adhesive label 60 for a period of time (for example, 0.4 sec) required for the movable blade 41 to move up and down. Specifically, the cutting by the cutter unit 40 is performed in a state where rotational drives of the printing platen roller 33, the draw-in rollers 54, and the thermal activation platen roller 53 are stopped.

For this reason, when a label length is longer than a distance from a cutting position of the cutter unit 40 to the heater elements 51 of the thermal-activation thermal head 52, the transport of the heat-sensitive adhesive label 60 is stopped in a state in which it is nipped between the thermal-activation thermal head 52 and the thermal activation platen roller 53.

As a result, the heat-sensitive adhesive layer that has started to exhibit its adhesiveness is undesirably stuck onto the thermal-activation thermal head 52 (heater elements 51), and the heat-sensitive adhesive label 60 is not smoothly transported even if the transport is resumed, causing malfunctions such as occurrence of so-called paper jam or transport failure. There is another problem in that heat from the heater elements 51 is transmitted to the printable layer (heat-sensitive color-developing layer) of the heat-sensitive adhesive label, thus developing this layer.

Accordingly, in the case of using the heat-sensitive adhesive label 60 with the above-described label length, it has been necessary to study a method (hereinafter, referred to as Method 1) enabling the cutting of the label without stopping the rotational drive of the thermal activation platen roller 53.

Besides this Method 1, it is conceivable to elongate the distance from the cutting position of the cutter unit 40 to the heater elements 51 of the thermal-activation thermal head 52 to be greater than the label length (hereinafter, referred to as Method 2). In this case, the above-described problems do not occur because the label length becomes shorter than the distance from the cutting position of the cutter unit 40 to the heater elements 51 of the thermal-activation thermal head 52. Hence, the cutting is performed after the rotational drive of the printing platen roller 33 is once stopped, the label is made to run again thereafter, and then the heat-sensitive adhesive layer of the label can be thermally activated.

However, in Method 2, it is necessary to secure the distance from the cutting position of the cutter unit 40 to the heater elements 51 of the thermal-activation thermal head 52 in accordance with the longest label length among a variety of lengths of labels to be printed. For this reason, a printer body is enlarged, and applications of the printer become limited. Hence, in order to make the printer capable of handling various types of labels without increasing a size of the printer or without regard to the label length, the above-described Method 1 must be adopted.

As a result of diligent studies, the inventors of the present invention found the following method as a method capable of performing the label cutting for labels having a length larger than the distance from the cutting position of the cutter unit 40 to the heater elements 51 of the thermal-activation thermal head 52 without increasing the size of the printer or without stopping the rotation of the thermal activation platen roller 53. In the found method, the transport speed (print speed) by the printing platen roller 33 is increased to be higher than the transport speed (activation speed) by the thermal activation platen roller 53, causing the label to sag within the distance from the cutting position of the cutter unit 40 to the heater elements 51 of the thermal-activation thermal head 52.

However, though this method is suitable in the case of the heat-sensitive adhesive label, two problems as will be described below are expected to occur when applying this method to an ordinary label (one in which a sheet label is stuck onto the release paper). Accordingly, this method is implemented only in a printer dedicated for the heat-sensitive adhesive label.

1) Ends of the sheet label on the release paper are peeled in a warped portion and caught on the entrance portion of the thermal activation unit 50, causing the paper jam.
2) The release paper is heated by the thermal-activation thermal head 52, causing danger in handling.

SUMMARY OF THE INVENTION

In consideration of the above-described circumstances, it is therefore an object of the present invention to provide a printer capable of printing on both of the heat-sensitive adhesive label and the ordinary label in which the release paper is affixed on the adhesive surface.

In order to achieve the above object, a printer of the present invention includes a printing device having printing means for performing printing on one surface of a continuous tape-like sheet and a first transporting means for transporting the sheet in a predetermined direction; a cutter device which is provided downstream of the printing device and cuts the sheet into a predetermined length; a thermal activation device which is provided downstream of the cutter device and has heating means for heating the other surface of the sheet and a second transporting means for transporting the sheet in the predetermined direction; a space portion which is provided between the cutter device and the thermal activation device and where the sheet can be warped by a predetermined length; and a control device which controls the printing device, the cutter device, and the thermal activation device differently between a case where the sheet is a heat-sensitive adhesive label in which a printable layer is formed on one surface of a sheet-like base material and a heat-sensitive adhesive layer is formed on the other surface of the sheet-like base material and a case where the sheet is an ordinary label in which a printable layer is formed on one surface of a label base material, a heat-sensitive adhesive layer is formed on the other surface of the label base material, and the label base material is stuck onto tape-like release paper. Therefore, both of the heat-sensitive adhesive label and the ordinary label are usable in the printer of the present invention.

It is preferable that operation of the control device is switched by a switching signal between a case where the heat-sensitive adhesive label is used and a case where the ordinary label is used. Therefore, the operations can be switched automatically.

It is preferable that the control device sets a transport speed of the first transporting means faster than a transport speed of the second transporting means when the sheet is the heat-sensitive adhesive label, and sets the transport speed of the first transporting means and the transport speed of the second transporting means equal to each other when the sheet is the ordinary label.

Particularly, it is preferable that when the sheet is the heat-sensitive adhesive label, the control device sets the transport speed of the first transporting means faster than a transport speed of the second transporting means to warp the heat-sensitive adhesive sheet by a predetermined length between the cutter device and the thermal activation device, and then stops operations of the printing means and the first transporting means while continuing operations of the heating means and the second transporting means to cut the heat-sensitive adhesive label by the cutter device, and that when the sheet is the ordinary label, the control device sets the transport speed of the first transporting means and the transport speed of the second transporting means equal to each other, stops operation of the heating means, operates the printing means and the first and second transporting means to transport the ordinary label, and stops operations of the first and second transporting means to cut the ordinary label by the cutting device.

Accordingly, when the sheet is the heat-sensitive adhesive label, the transport speed of the first transporting means is set faster than the transport speed of the second transporting means to secure a warp amount of a desired length or more which takes into account an expected time period for a cutting operation that follows, thus making it possible to cut the heat-sensitive adhesive label by the cutter device without stopping the transport of the heat-sensitive adhesive label by the second transporting means of the thermal activation device. Accordingly, malfunctions including an occurrence of paper jam caused by sticking of the heat-sensitive adhesive label onto the heating means can be solved, and in addition, extra maintenance such as discharging a label causing the paper jam becomes unnecessary. Hence, manufacturing efficiency of sticker labels can be significantly improved.

Meanwhile, in the case of the ordinary label, at the time of cutting the label by the cutter device, even if the transport of the ordinary label is stopped in a state where the ordinary label is present between the heating means and the second transporting means of the thermal activation device, the heating means is not driven, and accordingly, a problem that the printable layer (heat-sensitive color-developing layer) of the ordinary label is developed accidentally or the problem of danger presented by overheating of the ordinary label do not occur.

It is preferable that, in the case of the ordinary label, when the label is not to be cut one by one, the above-described control device control the cutter device to operate only at the time when printing on the last label is completed.

In the above-described printer, it is preferable that the first transporting means comprises a printing platen roller opposed to the printing means, and the second transporting means comprises a thermal activation platen roller opposed to the heating means, and that a pressing force with which the thermal activation platen roller is pressed toward the heating means during transporting of the ordinary label is set smaller than a pressing force applied during transporting of the heat-sensitive adhesive label. Therefore, no meandering or skewing occur while the ordinary label, which is thicker than the heat-sensitive adhesive label due to the release paper, is being transported, and the printing can be performed favorably on the label.

It is preferable that the printer switches a setting for the pressing force, with which the thermal activation platen roller is pressed toward the heating means, upon receiving the switching signal.

The switching signal is one to be transmitted based on one of: a configuration of the sheet; a configuration of a tube having the sheet wound therearound in a roll shape; a configuration of a support shaft which supports the tube; a position of a holder to which the support shaft is attached; a black mark on the sheet; switching of a switch; and input data.

DETAILED DESCRIPTION OF THE PREFERRED EMBODIMENT

An embodiment of the present invention will now be described with reference to the drawings.

(Configuration of Printer)

Figure 1:
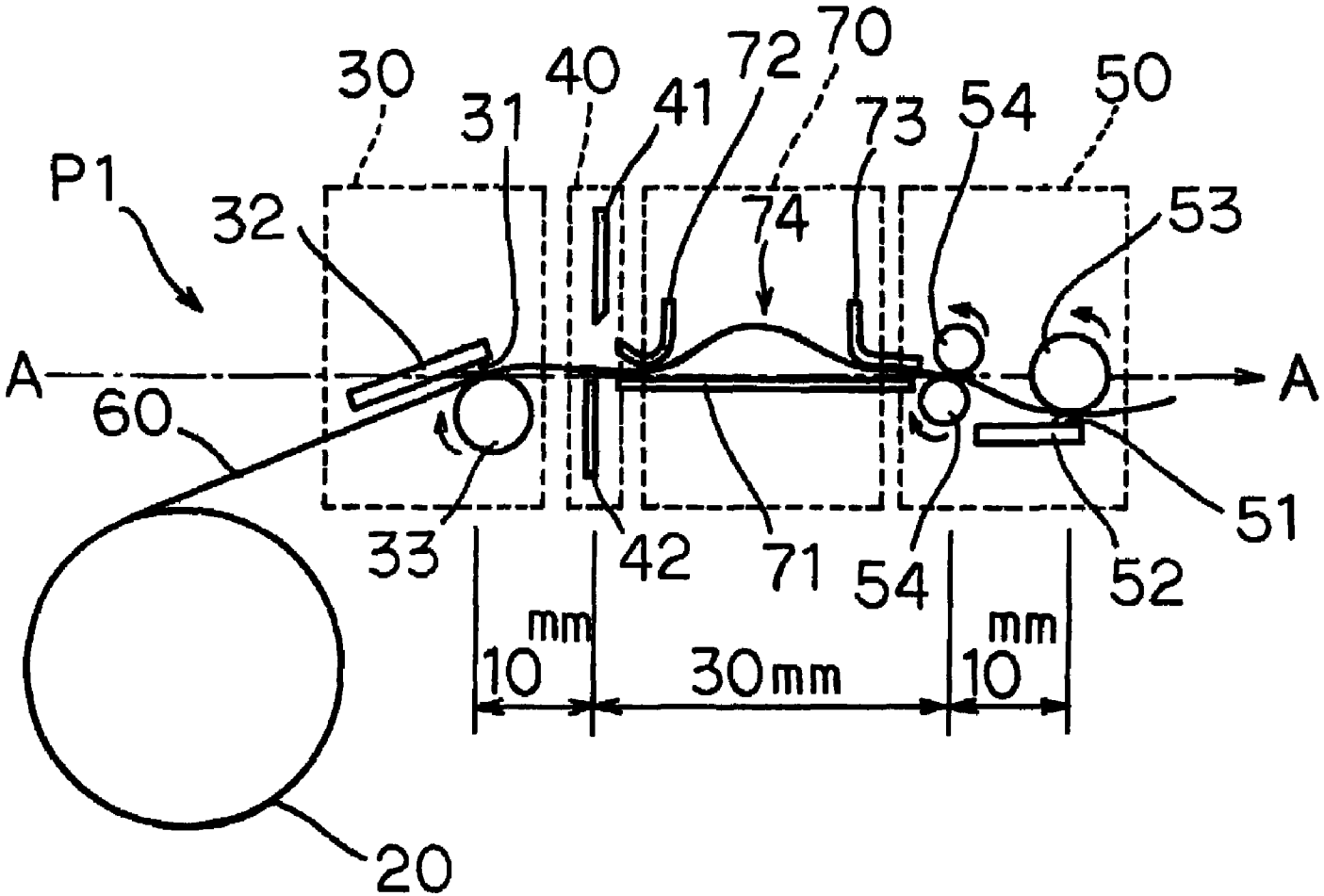
FIG. 1 is a schematic view showing a configuration of a thermal printer P1 according to an embodiment of the present invention.

FIG. 1 is a schematic view showing a configuration of a thermal printer 1 as the embodiment of the present invention.

The thermal printer P1 is an apparatus usable for both of a heat-sensitive adhesive label and an ordinary label.

This printer apparatus is composed of a roll housing unit 20 which holds a tape-like heat-sensitive adhesive label 60 and a tape-like ordinary label (not shown), each of which is wound in a roll shape, such that those labels are exchangeable, a printing unit 30 which prints on the heat-sensitive adhesive label 60 or the ordinary label which is held in the roll housing unit 20, a cutter unit 40 which cuts the heat-sensitive adhesive label 60 or the ordinary label into pieces with a predetermined length, a thermal activation unit 50 as a thermal activation device which functions only in the case where the heat-sensitive adhesive label 60 is held in the roll housing unit 20 and which thermally activates a heat-sensitive adhesive layer of the heat-sensitive adhesive label 60, a guide unit 70 serving as sheet guiding means for guiding the heat-sensitive adhesive label 60 from the cutter unit 40 to the thermal activation unit 50 and as a sheet storage portion, a control unit which controls the above-described respective constituent units to operate differently between the case of using the ordinary label and the case of using the heat-sensitive adhesive label 60, and the like. Note that FIG. 1 shows the case of using the heat-sensitive adhesive label 60.

Here, though not particularly limited, the heat-sensitive adhesive label 60 to be used in this embodiment has a structure in which, for example, a heat insulating layer and a heat-sensitive color-developing layer (printable layer) are formed on a front side of a label base, and the heat-sensitive adhesive layer obtained by coating and drying a heat-sensitive adhesive is formed on a backside thereof. Note that the heat-sensitive adhesive layer is composed of a heat-sensitive adhesive mainly containing thermoplastic resin, solid plastic resin, or the like. Moreover, the heat-sensitive adhesive label 60 may be one that does not have the heat insulating layer or one provided with a protective layer or a colored printed layer (preprinted layer) on the surface of the heat-sensitive color-developing layer. Meanwhile, though having been described in the related art, the ordinary label is one pasted on a long sheet (called a mount, a liner or release paper) of which surface is coated with silicon so that an adhesive coated on one side of the label cannot be attached onto the other. This long sheet is to be discarded as industrial waste upon label sticking.

The printing unit 30 is composed of a thermal print head 32 having a plurality of heater elements 31 composed of relatively small resistors arranged in a width direction so as to enable dot printing, a printing platen roller 33 to be brought into press contact with the thermal print head 32, and the like. Note that the heater elements 31 are configured similarly to those of a printing head of a publicly known thermal printer, which are formed by providing a protective film of crystallized glass on surfaces of a plurality of heater resistors formed on a ceramic substrate by a thin film formation technique, and accordingly, detailed description thereof will be omitted.

Moreover, the printing unit 30 includes a drive system (not shown) which rotationally drives the printing platen roller 33, the drive system being composed of, for example, a stepping motor and a gear train, or the like. The printing unit 30 is configured in the following manner. By the drive system, the printing platen roller 33 is rotated in a predetermined direction, and thus the ordinary label or the heat-sensitive adhesive label 60 loaded in the roll housing unit 20 is drawn out, and the thus drawn ordinary label or heat-sensitive adhesive label 60 is sent out in a predetermined direction as the thermal print head 32 performs printing thereon. In FIG. 1, the printing platen roller 33 is rotated clockwise, and the heat-sensitive adhesive label 60 is transported to the right side. Furthermore, the printing unit 30 includes pressurizing means (not shown) composed of a coil spring, a leaf spring, or the like, and is configured to press the printing platen roller 33 toward the thermal head 32 by the elastic force of this pressurizing means. In this case, a rotation axis of the printing platen roller 33 and an arraying direction of the heater members 31 are kept parallel to each other, thus making it possible to bring the printing platen roller 33 into press contact with the heat-sensitive adhesive label 60 along the entire width thereof.

Note that, in the case of using the ordinary label, rotation speed of the printing platen roller 33 is set equal to rotation speed of a thermal activation platen roller 53, and set at a greater speed than the rotation speed of the thermal activation platen roller 53 in the case of using the heat-sensitive adhesive label 60.

The cutter unit 40 is one for cutting the ordinary label or the heat-sensitive adhesive label 60, on which printing has been performed by the printing unit 30, into pieces with an appropriate length, and is composed of a movable blade 41 operated by a drive source (not shown) such as an electric motor, a stationary blade 42 opposed to this movable blade, and the like.

The guide unit 70 is composed of a plate-shaped guide (first guide) 71 provided on a transport path from the cutter unit 40 to the thermal activation unit 50, and guides (second guides) 72 and 73 bent upward approximately at a right angle, which are provided on a sending-out portion of the cutter unit 40 and a label receiving portion of the thermal activation unit 50, respectively. Moreover, the space between the second guides 72 and 73 is made open, and serves as a label storage portion 74 where the label can be temporarily warped by a predetermined amount.

Note that the second guides 72 and 73 may be composed of one member formed as the sheet storage portion whose upper portion is formed concave, or that the first guide 71 and the second guides 72 and 73 may be reversed vertically. In the latter case, the label storage portion 74 is formed below with respect to a transport direction.

The thermal activation unit 50 is composed of a thermal-activation thermal head 52 serving as heating means having heater elements 51, the thermal activation platen roller 53 serving as transporting means for transporting the ordinary label or the heat-sensitive adhesive label 60, a pair of draw-in rollers 54 which are rotated by a drive source (not shown) such as, for example, a stepping motor, and draw the ordinary label or the heat-sensitive adhesive label 60 supplied from the printing unit 30 side into between the thermal-activation thermal head 52 and the thermal activation platen roller 53, and the like. However, in the case of transporting the ordinary label, the thermal-activation thermal head 52 is not driven, and transporting of the ordinary label alone is performed.

Note that, in this embodiment, used for the thermal-activation thermal head 52 is one configured similarly to the thermal print head 32, that is, one configured similarly to the printing head of the publicly known thermal printer, which is formed by providing the protective film of the crystallized glass on the surfaces of the plurality of heater resistors formed on the ceramic substrate by the thin film-formation technique. In this way, as the thermal-activation thermal head 52, the one configured similarly to the thermal print head 32 is used, thus achieving commonality of parts to enable cost reduction. However, the heater elements 51 of the thermal-activation thermal head 52 do not have to be divided per dot in a way similar to the heater elements 31 of the thermal print head 32, and may be formed as a continuous resistor.

Moreover, the thermal activation unit 50 includes a drive system which rotates the thermal activation platen roller 53, the drive system being composed of, for example, a stepping motor and a gear train, or the like. The thermal activation platen roller 53 is rotated by this drive system in a direction reverse to the rotation direction of the printing platen roller 33 (counterclockwise in FIG. 1) to transport the heat-sensitive adhesive label 60 in a predetermined direction (right side in FIG. 1). Moreover, the thermal activation unit 50 includes pressurizing means (for example, a coil spring or a leaf spring) for pressing the thermal activation platen roller 53 toward the thermal head 52. In this case, a rotation axis of the thermal activation platen roller 53 and an arraying direction of the heater members 51 are kept parallel to each other, thus making it possible to bring the thermal activation platen roller 53 into press contact with the normal label or the heat-sensitive adhesive label 60 along the entire width thereof. However, in the case of transporting the ordinary label, the ordinary label is thicker than the heat-sensitive adhesive label because the ordinary label includes the release paper, and accordingly, it is preferable to reduce the pressing force of the thermal activation platen roller 53 to prevent meandering or skewing of the label during the transport.

Figure 2:
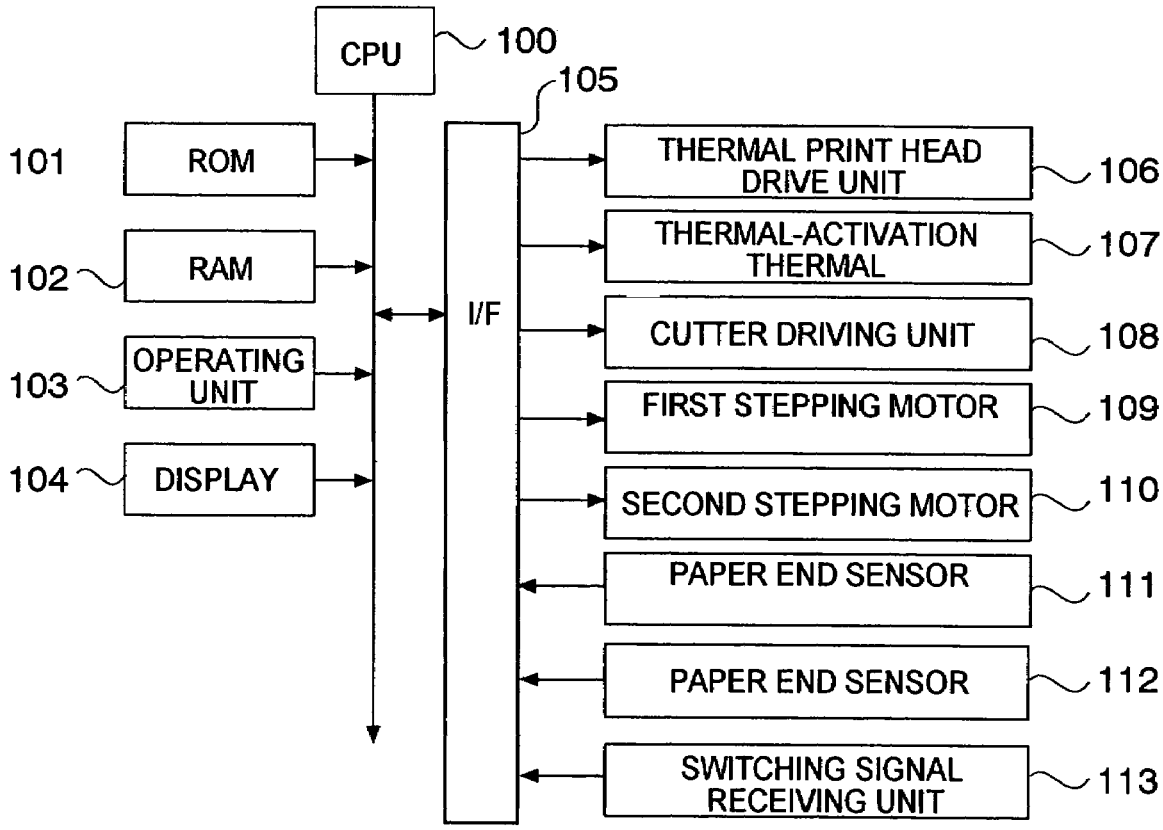
FIG. 2 is a control block diagram of the thermal printer P1 according to the embodiment of the present invention.

FIG. 2 is a control block diagram of the thermal printer P1. A control unit of the thermal printer P1 is composed of a CPU 100 as a control device which supervises the control unit, a ROM 101 which stores a control program and the like executed by the CPU 101, a RAM 102 which stores a variety of print formats and the like, an operation unit 103 for entering, setting, or calling print data, print format data, and the like, a display unit 104 which displays the print data and the like, an interface 105 which handles data inputs and outputs between the control unit and drive units, a drive unit (circuit) 106 which drives the thermal print head 32, a drive unit (circuit) 107 which drives the thermal-activation thermal head 52, a drive unit (circuit) 108 which drives the movable blade 41 that cuts the heat-sensitive adhesive label 60, a first stepping motor 109 which drives the printing platen roller 33, a second stepping motor 110 which drives the thermal activation platen roller 53 and the draw-in rollers 54, a paper end sensor 111 (not shown in FIG. 1) which monitors transporting of the sheet-like ordinary label or the sheet-like heat-sensitive adhesive label 60 to the heater elements 31 of the thermal print head 32, a paper end sensor 112 (not shown in FIG. 1) which monitors transporting of the sheet-like ordinary label or the sheet-like heat-sensitive adhesive label 60 to the heater elements 51 of the thermal-activation thermal head 52, a switching signal receiving unit 113 which receives a signal (switching signal) for switching from a control condition for the ordinary label to a control condition for the heat-sensitive adhesive label, and the like.

Based on control signals transmitted from the CPU 100, desired printing is executed in the printing unit 30, a cutting operation is executed at predetermined timing in the cutter unit 40, and activation of a heat-sensitive adhesive layer 64 is executed in the thermal activation unit 50.

Moreover, the CPU 100 is configured to be capable of transmitting control signals independently to the first stepping motor 109 and the second stepping motor 110. Accordingly, the rotation speeds of the rollers 33, 53, and 54 driven by the respective stepping rollers, that is, transport speed of the heat-sensitive adhesive label 60 can be controlled independently for each of the rollers.

Note that a configuration may be adopted in which the drive sources (stepping motors) for the thermal activation platen roller 53 and the draw-in rollers 54 are provided separately from each other to be controllable independently of each other.

Moreover, the paper end sensor 111 is provided in front of the printing unit 30, and detects the leading edge of the sheet-like ordinary label or the sheet-like heat-sensitive adhesive label 60. Based on this detection, the drive of the printing platen roller 33 is started. Further, based on detection of the trailing edge of the sheet-like ordinary label or the sheet-like heat-sensitive adhesive label 60 by this paper end sensor 111, the drive of the thermal activation platen roller 53 is stopped, and printing and transport of the next ordinary label or heat-sensitive adhesive label 60 is performed.

Further, the paper end sensor 112 is provided in front of the thermal activation unit 50, and detects the leading edge of the sheet-like ordinary label or the sheet-like heat-sensitive adhesive label 60. Based on this detection, the drives of the draw-in rollers 54 and the thermal activation platen roller 53 are started. Further, based on detection of the trailing edge of the sheet-like ordinary label or the sheet-like heat-sensitive adhesive label 60 by this paper end sensor 112, the drives of the draw-in rollers 54 and the thermal activation platen roller 53 are stopped, and printing, transport, and thermal activation of the next ordinary label or heat-sensitive adhesive label 60 are performed.

Next, operations of the printer of this embodiment when using the heat-sensitive adhesive label and when using the ordinary label will be described.

In this embodiment, the distance from the printing platen roller 33 (thermal print head 32) to the movable blade 41 is set at 10 mm, the distance from the movable blade 41 to the draw-in rollers is set at 30 mm, and the distance from the draw-in rollers 54 to the thermal activation platen roller 53 (thermal-activation thermal head 52) is set at 10 mm. Further, a drive time of the movable blade 41, which is required for the label cutting, is set at 0.4 sec, and the label length is set at 200 mm.

Moreover, the transport speed (activation speed Vh) by the thermal activation platen roller 53 is set constant at 100 mm/sec in consideration of a thermal activation time of the heat-sensitive adhesive layer. When using the ordinary label, the transport speed (print speed Vp) by the printing platen roller 33 is set at 100 mm/sec which is equal to the activation speed Vh (Vp=Vh), and when using the heat-sensitive adhesive label, the transport speed can be set at 200 mm/sec which is higher than the activation speed Vh (Vp>Vh). Moreover, the transport speed by the draw-in rollers 54 can be set at 100 mm/sec which is equal to the activation speed Vh.

(Operation when Using Heat-sensitive Adhesive Label)

An example of the printer operation when using the heat-sensitive adhesive label will be described.

When using the heat-sensitive adhesive label, the thermal printer P1 adopts a method of warping the label by stopping the rotational drive of the draw-in rollers 54 at the time when the leading edge of the sheet-like heat-sensitive adhesive label 60 comes in between the draw-in rollers 54 and the thermal activation platen roller 53. FIGS. 3A to 3E are explanatory views showing an example of a label transport state in the case of using the heat-sensitive adhesive label 60.

Figure 3A:
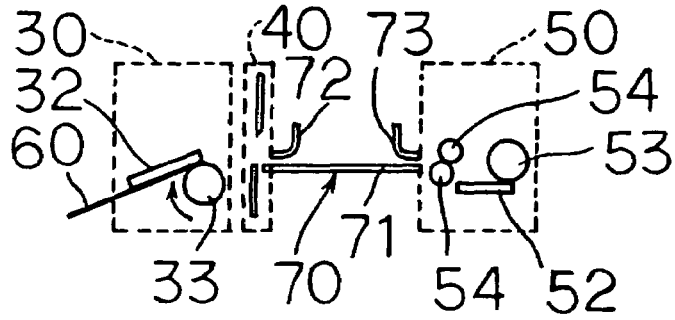
FIGS. 3A to 3E are explanatory views showing an example of a label transport state in a case of using a heat-sensitive adhesive label in the printer of the present invention.
Figure 3B:
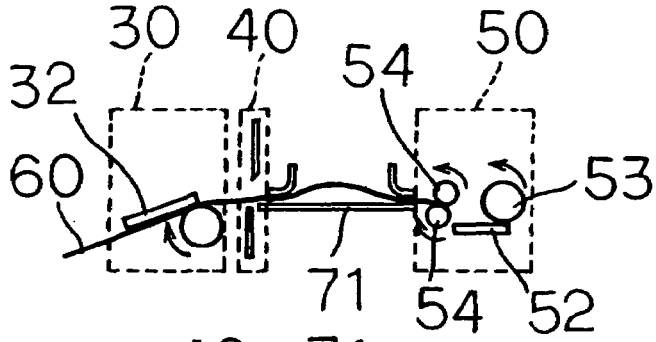

First, the sheet-like heat-sensitive adhesive label 60 wound in the roll shape is loaded in the roll housing unit (not shown) Further, on the printer body side, it is determined upon receiving the switching signal to be described later that the label has been switched to the heat-sensitive adhesive label 60. Thereafter, when the heat-sensitive adhesive label 60 is transported to a position immediately in front of the printing unit 30 and the leading edge thereof is detected by the unillustrated paper end sensor (denoted by reference numeral 111 in FIG. 2), the printing platen roller 33 rotates, and printing control for the thermal print head 32 is started. The tape-like heat-sensitive adhesive label 60 that has been transported is nipped between the printing platen roller 33 and the thermal print head 32. Then, while the heat-sensitive adhesive label 60 is being drawn at 200 mm/sec by the rotational drive of the printing platen roller 33, printing is performed on the printable layer (heat-sensitive color-developing layer) by the thermal print head 32 (FIG. 3A).

Subsequently, the heat-sensitive adhesive label 60 is sent out from the printing unit 30 by the rotational drive of the printing platen roller 33, and transported to the cutter unit 40. Then, when the heat-sensitive adhesive label 60 is transported by self weight thereof along the first guide 71 and the leading edge thereof is detected by the unillustrated paper end sensor (denoted by reference numeral 112 in FIG. 2), the draw-in rollers 54 and the thermal activation platen roller 53 are rotationally driven. Here, the drive sources for the draw-in rollers 54 and the thermal activation platen roller 53 are the same (second stepping motor 110), and accordingly, the drive timings of the draw-in rollers 54 and the thermal activation platen roller 53 become the same.

Figure 3C:
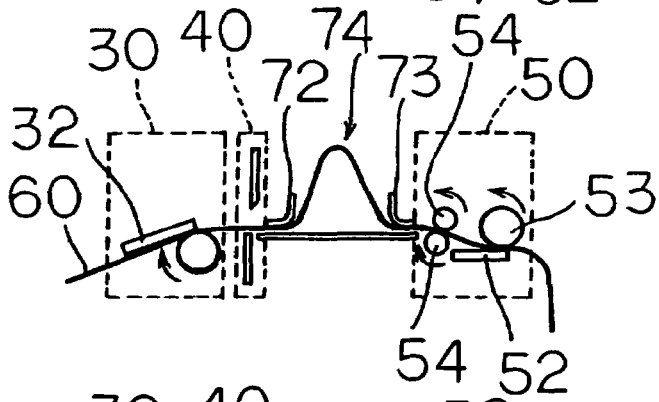

Thereafter, the heat-sensitive adhesive label 60 reaches the thermal activation unit 50 (draw-in rollers 54) (FIG. 3B), and is sent out from the draw-in rollers 54 and also transported by the thermal activation platen roller 53. The drive sources for the draw-in rollers 54 and the thermal activation platen roller 53 are the same and thus no difference in transport speed occurs therebetween. Accordingly, no slack of the heat-sensitive adhesive label 60 occurs between the draw-in rollers 54 and the thermal activation platen roller 53, or no undue tension is applied therebetween. However, the transport speed (200 mm/sec) of the printing platen roller 33 is set larger than the transport speed (100 mm/sec) of the draw-in rollers 54 and the thermal activation platen roller 53, and accordingly, between the draw-in rollers 54 (thermal activation platen roller 53) and the printing platen roller 33, slack occurs in the heat-sensitive adhesive label 60 (FIG. 3C)

In this case, because the heat-sensitive adhesive label 60 is sent out or inserted at a predetermined angle, a direction in which the label sags is determined in accordance with an inclination thereof (upward in FIG. 3). Moreover, the heat-sensitive adhesive label 60 comes to sag in the label storage portion 74 so as to be bowed upward by operations of the second guides 72 and 73, and accordingly, no undue stress is applied to the label. Hence, even if the heat-sensitive adhesive label 60 is warped, a deterioration of the exterior appearance of the label, which may result from a wrinkle caused by the warp, can be avoided. Moreover, because of the warp of the above-described label, a label cutting operation to be described later can be executed without stopping the rotational drives of the draw-in rollers 54 and the thermal activation platen roller 53.

Figure 3D:
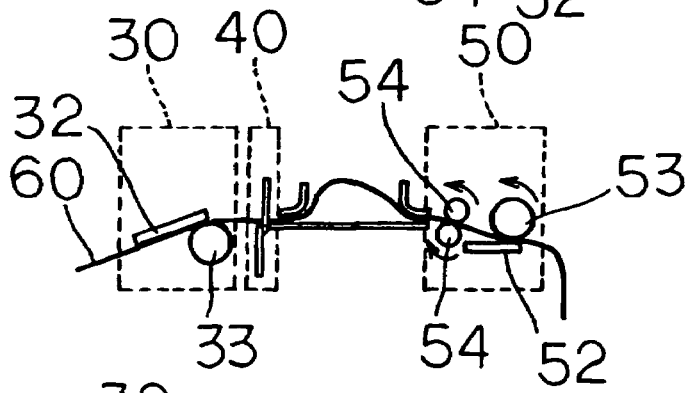

While securing a warp amount of a desired length or more which takes into account an expected time period of the cutting operation that follows (obtained by multiplication of the activation speed Vh and the cutting operation time T) by the rotational drives of the three rollers 33, 54, and 53, the printing is performed for the heat-sensitive adhesive label 60 while the label is being thermally activated. Then, when predetermined printing is completed and a desired cut position in the heat-sensitive adhesive label 60 reaches the cutter unit 40, the rotational drive of the printing platen roller 33 is stopped, and the heat-sensitive adhesive label 60 is cut by driving the movable blade 41 for a predetermined period of time (0.4 sec) (FIG. 3D). At this time, because the rotational drives of the draw-in rollers 54 and the thermal activation platen roller 53 are continued, so that the leading edge portion of the heat-sensitive adhesive label 60 continues to be transported. However, the cutting is completed during the period in which the sagging label is transported.

Figure 3E:
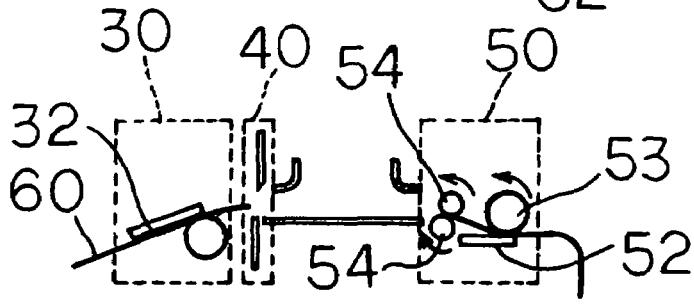

Then, when the trailing edge of the heat-sensitive adhesive label 60 that has been cut passes through the draw-in rollers 54, the heat-sensitive adhesive label 60 is discharged as it is by the thermal activation platen roller 53 (FIG. 3E).

The operation example of the printer when using the heat-sensitive adhesive label, which has been described above, is effective for the label length which allows for a warp amount sufficient to continue the rotational drive of the thermal activation platen roller 53 at the time of the cutting operation even if the printing is performed on the print surface while thermally activating the heat-sensitive adhesive surface. However, there are cases where a sufficient warp amount cannot be secured depending on the label length if the printing is performed while thermally activating the heat-sensitive adhesive surface. In this case, the warp amount can be secured also by temporarily holding the label before the thermal activation.

This operation example of the printer will be described with reference to FIG. 4.

Referring to FIG. 4, the sheet-like heat-sensitive adhesive label 60 wound in the roll shape is nipped between the printing platen roller 33 and the thermal print head 32. Then, while the heat-sensitive adhesive label 60 is being drawn at 200 mm/sec by the rotational drive of the printing platen roller 33, printing is performed on the printable layer (heat-sensitive color-developing layer) by the thermal print head 32 (FIG. 4A).

Subsequently, the heat-sensitive adhesive label 60 is sent out from the printing unit 30 by the rotational drive of the printing platen roller 33, and transported to the cutter unit 40. Then, when the heat-sensitive adhesive label 60 is transported by the self weight thereof along the first guide 71 and the leading edge thereof is detected by the unillustrated paper end sensor (denoted by reference numeral 112 in FIG. 2), the draw-in rollers 54 and the thermal activation platen roller 53 are rotationally driven.

Thereafter, the heat-sensitive adhesive label 60 reaches the thermal activation unit 50 (draw-in rollers 54) (FIG. 4B), and is sent out from the draw-in rollers 54. Then, at the time when the leading edge of the label comes in between the draw-in rollers 54 and the thermal activation platen roller 53, the rotational drives of the draw-in rollers 54 (and the thermal activation platen roller 53) are stopped (FIG. 4C). Thereafter, though the leading edge of the heat-sensitive adhesive label 60 is not sent out from the draw-in rollers 54 because the draw-in rollers 54 are not driven, the label is sent out from the printing unit 30 by the printing platen roller 33, and accordingly, a warp occurs.

In this case, because the heat-sensitive adhesive label 60 is sent out or inserted at a predetermined angle, a direction in which the label sags is determined in accordance with an inclination thereof (upward in FIG. 4). Further, the heat-sensitive adhesive label 60 comes to sag in the label storage portion 74 so as to be bowed upward by the operations of the second guides 72 and 73, and accordingly, no undue stress is applied to the label. Hence, even if the heat-sensitive adhesive label 60 is warped, a deterioration of the exterior appearance of the label, which may result from a wrinkle caused by the warp, can be avoided.

Figure 4D:
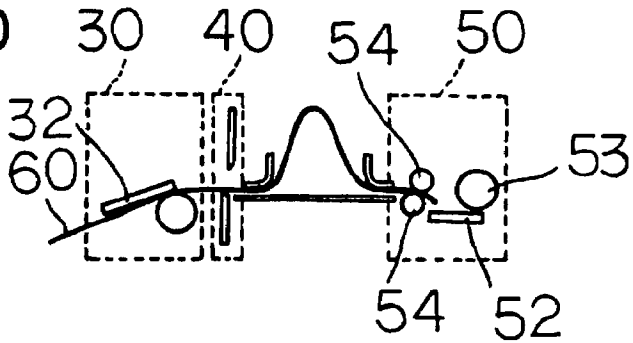
FIGS. 4A to 4F are explanatory views showing another example of the label transport state in the case of using the heat-sensitive adhesive label in the printer of the present invention.

A warp amount of a desired length or more, which takes into account an expected time period for the cutting operation that follows (obtained by the multiplication of the activation speed Vh and the cutting operation time T), is secured, and when predetermined printing is completed and a desired cut position in the heat-sensitive adhesive label 60 reaches the cutter unit 40, the rotational drive of the printing platen roller 33 is stopped (FIG. 4D).

Figure 4E:
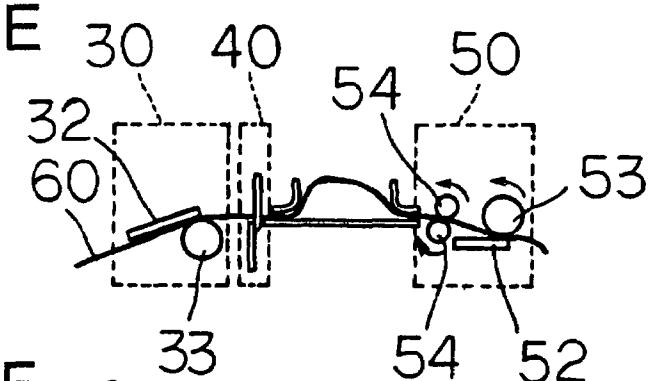

Then, the rotational drive of the draw-in rollers 54 (and the thermal activation platen roller 53) is resumed. The heat-sensitive adhesive label 60 undergoes thermal activation while being transported at 100 mm/sec, and the heat-sensitive adhesive label 60 is cut by driving the movable blade 41 for a predetermined period of time (0.4 sec) (FIG. 4E).

Figure 4F:
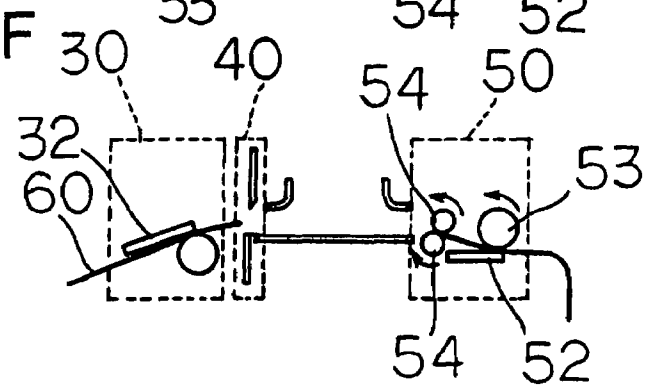
Figure 4A:
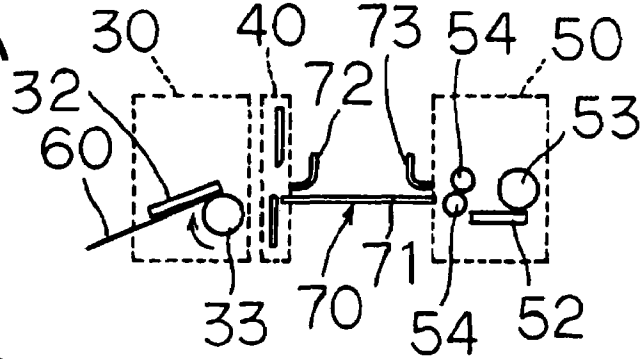
Figure 4B:
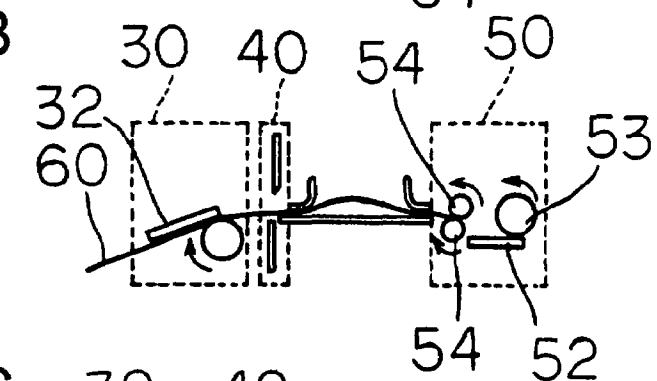
Figure 4C:
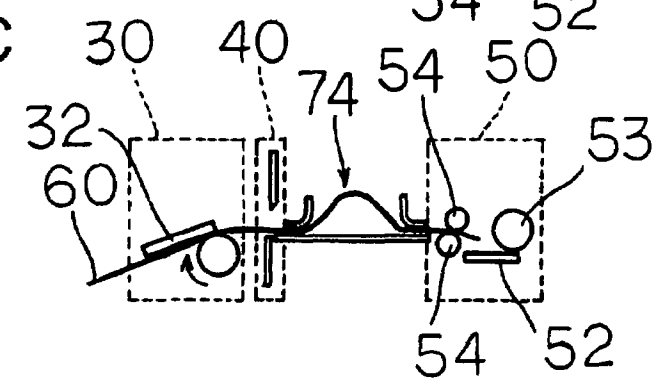

Thereafter, the heat-sensitive adhesive label 60 is transported by the rotational drives of the two rollers 54 and 53 while being thermally activated. Then, when the trailing edge of the heat-sensitive adhesive label 60 passes through the draw-in rollers 54, the heat-sensitive adhesive label 60 is discharged as it is by the thermal activation platen roller 53 (FIG. 4F).

In accordance with the respective operations of the printer, which have been described above, in the thermal printer P1 of this embodiment, the heat-sensitive adhesive label 60 can be cut by the cutter unit 40 without stopping transport of the heat-sensitive adhesive label in the thermal activation unit 50. Accordingly, occurrences of paper jam and a transport failure, which maybe caused as the heat-sensitive adhesive layer of the heat-sensitive adhesive label 60 sticks onto the thermal-activation thermal head 52 (heater elements 51), can be avoided.

Moreover, according to the above-described thermal printer P1, the heater elements 51 of the thermal-activation thermal head 52 are brought into contact with the heat-sensitive adhesive layer of the heat-sensitive adhesive label 60, and accordingly, heat conduction from the heater elements 51 to the heat-sensitive adhesive layer 64 is directly made, thus making it possible to perform the thermal activation efficiently. In addition, the heater elements 51 of the thermal head 52 can perform the thermal activation by generating heat only while being energized, and therefore, energy consumption for the thermal activation is reduced.

Note that, besides the above-described respective operations of the printer, the thermal activation may be performed in the following manner when the label cannot be warped because the label length is shorter than the distance from the cutting position of the cutter unit 40 to the heater elements 51 of the thermal-activation thermal head 52. Specifically, first, at the same time when the printing is completed and the rotational drive of the printing platen roller 33 is stopped, the rotational drives of the draw-in rollers 54 are stopped and the label is cut. Then, the label is transported again by the draw-in rollers 54 and the thermal activation platen roller 53. Also in this case, the leading edge of the label is made not to reach the thermal activation platen roller 53 at the time of the cutting operation.

(Operation when Using Ordinary Label)

An example of the printer operation when using the ordinary label will be described with reference to FIGS. 5A to 5E. Note that, in the case of the ordinary label, unlike in the case of using the heat-sensitive adhesive label, the switching signal is not transmitted to the control unit of the printer body. Because the control unit does not receive this switching signal, the control unit determines that the label used is the ordinary label, and as will be described later, sets the print speed Vp and the activation speed Vh equal to each other so as not to cause the "warp" that occurs in the case of using the heat-sensitive adhesive label, and performs control such that the thermal-activation thermal head 52 is not driven.

FIGS. 5A to 5E are explanatory views showing an example of a label transport state in the case of using an ordinary label 65.

Figure 5A:
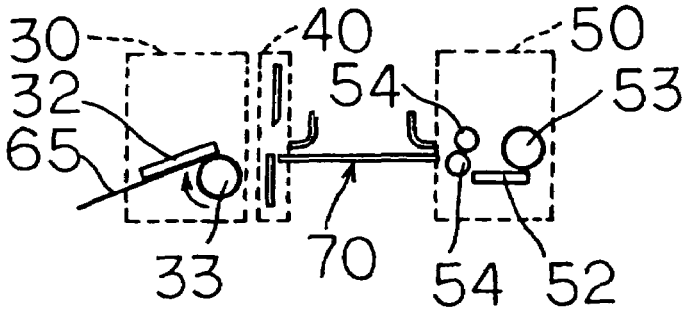
FIGS. 5A to 5E are explanatory views showing an example of a label transport state in a case of using an ordinary label in the printer of the present invention.
Figure 5B:
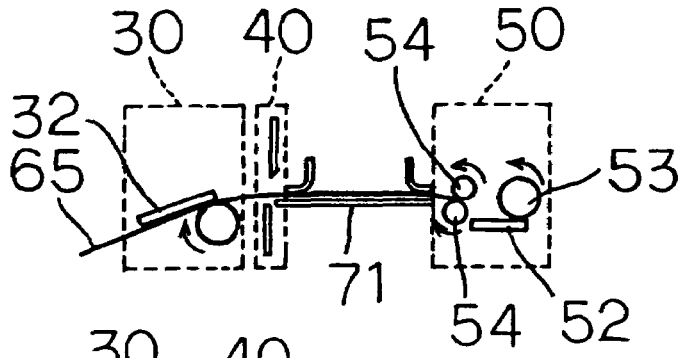

First, the tape-like ordinary label 65 wound in a roll shape is loaded in the roll housing unit (not shown). Thereafter, when the ordinary label 65 is transported to a position immediately in front of the printing unit 30 and the leading edge thereof is detected by the unillustrated paper end sensor (denoted by reference numeral 111 in FIG. 2), the printing platen roller 33 rotates, and printing control for the thermal print head 32 is started. The tape-like ordinary label 65 that has been transported is nipped between the printing platen roller 33 and the thermal print head 32. Then, while the ordinary label 65 is being drawn at 100 mm/sec by the rotational drive of the printing platen roller 33, printing is performed on the printable layer (heat-sensitive color-developing layer) by the thermal print head 32 (FIG. 5A).

Subsequently, the ordinary label 65 is sent out from the printing unit 30 by the rotational drive of the printing platen roller 33, and transported to the cutter unit 40. Then, when the ordinary label 65 is transported by self weight thereof along the first guide 71 and the leading edge thereof is detected by the unillustrated paper end sensor (denoted by reference numeral 112 in FIG. 2), the draw-in rollers 54 and the thermal activation platen roller 53 are rotationally driven. Here, the drive sources for the draw-in rollers 54 and the thermal activation platen roller 53 are the same (second stepping motor 110), and accordingly, the drive timings of the draw-in rollers 54 and the thermal activation platen roller 53 become the same.

Figure 5C:
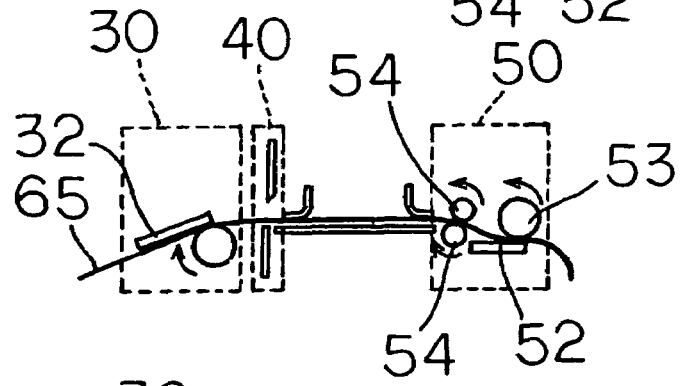

Thereafter, the ordinary label 65 reaches the thermal activation unit 50 (draw-in rollers 54) (FIG. 5B), and is sent out from the draw-in rollers 54 and also transported by the thermal activation platen roller 53 (FIG. 5C). The drive sources for the draw-in rollers 54 and the thermal activation platen roller 53 are the same, and thus no difference in transport speed occurs therebetween. Accordingly, no slack of the ordinary label 65 occurs between the draw-in rollers 54 and the thermal activation platen roller 53, or no undue tension is applied therebetween. Moreover, the transport speed (100 mm/sec) of the draw-in rollers 54 and the printing platen roller 53 and the transport speed (100 mm/sec) of the printing platen roller 33 are set equal to each other, and accordingly, no slack of the ordinary label 65 occurs between the draw-in rollers 54 (thermal activation platen roller 53) and the printing platen roller 33, either, or no undue tension is applied therebetween, either. Moreover, in this example, the thermal-activation thermal head 52 is not driven in order to allow the ordinary label 65 to pass between the pair of draw-in rollers 54 and between the thermal activation platen roller 53 and the thermal-activation thermal head 52.

Figure 5D:
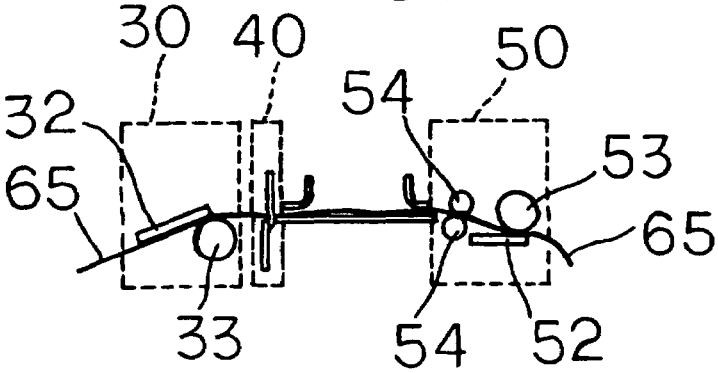

Thereafter, when a desired cut position in the ordinary label 65 reaches the cutter unit 40, the rotational drives of the printing platen roller 33, the draw-in rollers 54, and the thermal activation platen roller 53 are stopped, and thus the printing by the thermal print head 32 is temporarily stopped, and the ordinary label 65 is cut by driving the movable blade 41 for a predetermined period of time (0.4 sec) (FIG. 5D).

Figure 5E:
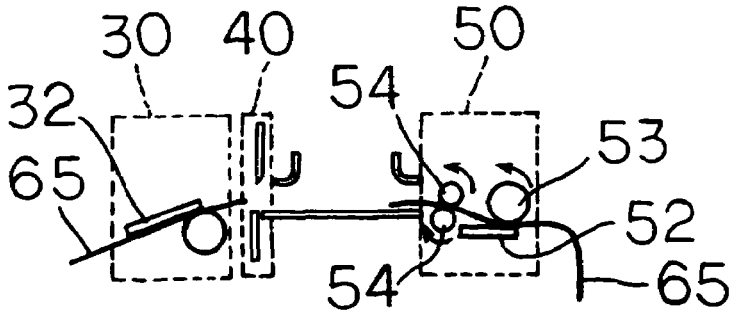

Then, the ordinary label 65 that has been cut is discharged by the rotational drives of the draw-in rollers 54 and the thermal activation platen roller 53 (FIG. 5E).

In the case of using the ordinary label, which has been described above, in the thermal printer P1 of this embodiment, the thermal-activation thermal head 52 is not driven even when the transport of the ordinary label 65 is stopped in a state where the ordinary label 65 is present between the thermal activation-thermal head 52 and the thermal activation platen roller 53 at the time of cutting the ordinary label. Accordingly, a problem that the printable layer (heat-sensitive color-developing layer) of the ordinary label 65 is developed accidentally and the problem of danger presented by overheating of the ordinary label 65 do not occur.

Note that, in the case of the ordinary label, the label is used more often for the following application rather than for an application where printing is performed for each one label, which is then cut for sticking. Specifically, "one-time sticking", in which printing is previously implemented for a predetermined number of labels on a tape-like mount, and the labels are then collectively stuck all at once. Meanwhile, in the case of the heat-sensitive adhesive label, adhesive strength thereof deteriorates when the label is left after the thermal activation of the heat-sensitive adhesive surface is implemented. Accordingly, it is necessary to stick the labels immediately after the label issuance. Hence, when issuing the ordinary label, it is desirable, after selecting between performing and not performing cutting for the labels one by one and when cutting is not to be performed for the labels one by one, to switch a control method so that the number of issued labels is counted in accordance with data on the number of labels to be issued continuously and the cutter operates only upon issuance of the last label.

Furthermore, while sheet thickness of the heat-sensitive adhesive label ranges approximately from 80 to 120 μm, sheet thickness of the ordinary label ranges approximately from 110 to 150 μm, which is larger than that of the heat-sensitive adhesive label because the ordinary label includes the release paper or the like. For this reason, the pressing force with which the thermal activation platen roller 53 is pressed toward the thermal-activation thermal head 52 and pressure between the draw-in rollers 54 are increased to be higher than those applied when transporting the heat-sensitive adhesive label. This gives adverse effects such as meandering or skewing of the label during transport, a deterioration of printing quality, wear of the thermal head, and the like. Accordingly, when using the ordinary label, it is preferable to reduce the pressing forces of the above-described thermal activation platen roller 53 and draw-in rollers 54. For a mechanism to achieve this, one which automatically effects the above pressing-force reducing action simultaneously with the switching between the ordinary label and the heat-sensitive adhesive label is easy to operate, eliminating an error in adjusting the pressing force.

(Example of Switching Signal Transmitted when Using Heat-sensitive Adhesive Label)

Next, some types of switching signal received by the printer body side when switching is performed from the ordinary label to the heat-sensitive adhesive label will be described. In each case, the structure that produces the switching signal constitutes detecting means for detecting whether the label is an ordinary label or a heat-sensitive adhesive label, and the switching signal is supplied to the switching signal receiving unit 113.

In general, the tape-like heat-sensitive adhesive label is wound in a roll shape around a paper tube. Moreover, this paper tube is attached around a support shaft rotatably provided in the roll housing unit 20, thus making it possible for the printer body to perform printing on and thermally activate the heat-sensitive adhesive label.

In this connection, the above-described switching signal is transmitted when the paper tube having the tape-like heat-sensitive adhesive label wound therearound is attached around the support shaft of the roll housing unit 20 of the printer body, thus making it possible to detect that the switching has been performed from the ordinary label to the heat-sensitive adhesive label.

1) Example 1 of Determining Switching by Shape of Paper Tube

Figure 6A:
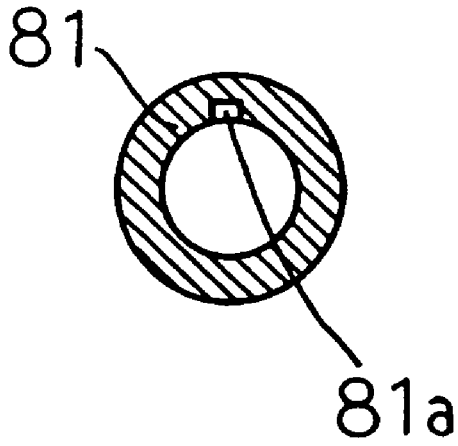
FIGS. 6A and 6B are views showing an example of a method of sensing switching of the labels in the printer of the present invention.
Figure 6B:
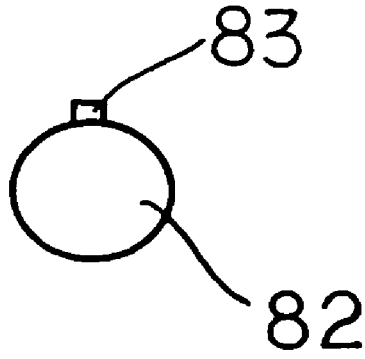

For example, as shown in FIG. 6A, a notch 81*a* is formed in an insertion hole of a paper tube 81 having the heat-sensitive adhesive label wound therearound, into which a support shaft 82 is inserted, and as shown in FIG. 6B, a protrusion 83 serving as a movable switch, which matches with the notch 81*a*, is provided on the support shaft 82. Meanwhile, no notch is formed in a support-shaft insertion hole of a paper tube having the ordinary label wound therearound. Accordingly, when the paper tube 81 having the heat-sensitive adhesive label wound therearound is attached around the support shaft 82, ON and OFF of the protrusion 83 are switched, thus making it possible to transmit the switching signal described above.

Further, a structure may be adopted in which the protrusion 83 on the support shaft 82 is of a stationary type, with the support shaft being dedicated for the heat-sensitive adhesive label, and a switch is provided on a part of this support shaft 82, or in which this support shaft 82 pushes a switch provided on a bearing, thus transmitting the above-mentioned switching signal.

2) Example 2 of Determining Switching by Shape of Paper Tube

Figure 7A:
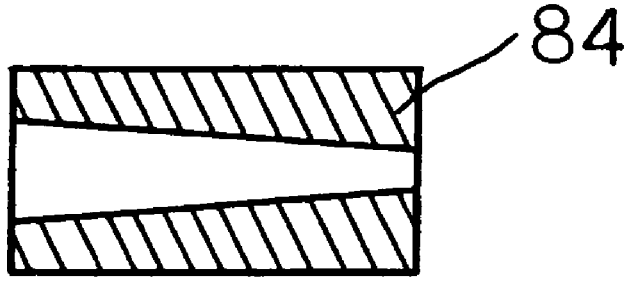
FIGS. 7A and 7B are views showing an example of a method of sensing switching of the labels in the printer of the present invention.
Figure 7B:
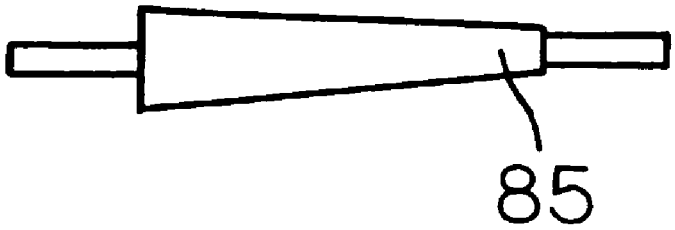

As shown in FIG. 7A, an inner shape of a paper tube 84 having the heat-sensitive adhesive label wound therearound is tapered, and as shown in FIG. 7B, a support shaft 85 having an outer shape in conformity with the inner shape of the paper tube 84 is dedicated for the heat-sensitive adhesive label. A structure may be adopted in which the above-described switching signal is transmitted as a switch provided on a part of this support shaft 85 is switched by attaching the paper tube 84 therearound, or by the support shaft 85 pushing a switch provided on the bearing.

3) Example of Determining Switching by Diameter of Paper Tube

Figure 8A:
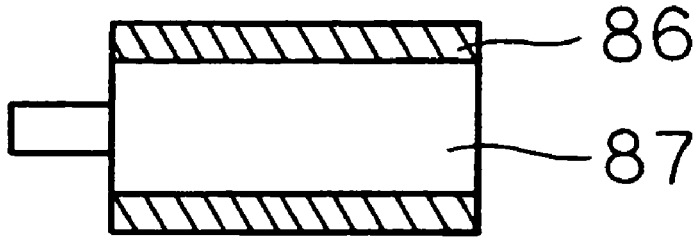
FIGS. 8A and 8B are views showing an example of a method of sensing switching of the labels in the printer of the present invention.
Figure 8B:
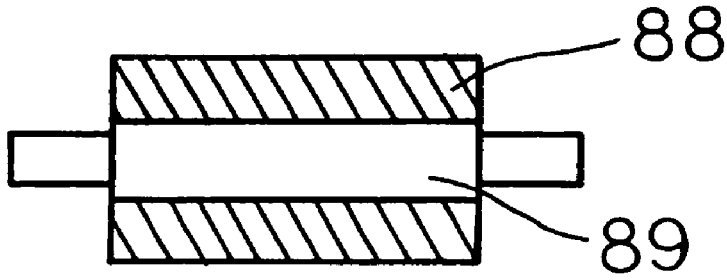

When the ordinary label is wound tightly, the leading edge portion of the label becomes apt to be peeled off from the release paper, and accordingly, as shown in FIG. 8A, an inner diameter of a paper tube 86 is set larger (for example, 2 to 3 inches). However, the heat-sensitive adhesive label does not have the release paper, and thus there is no fear of such peeling off. Accordingly, it is possible to eliminate the paper tube, or as shown in FIG. 8B, to set the inner diameter of the paper tube 88 small (for example, to 0.5 to 1 inch). Therefore, a difference occurs in outer diameter between a support shaft 87 for the ordinary label and a support shaft 89 for the heat-sensitive adhesive label. Hence, by detecting such a difference in outer diameter, or as the support shafts 87 and 89 push the switch provided on the bearing, and so on, it is determined whether the label used is the ordinary label or the heat-sensitive adhesive label, and the above-described switching signal is transmitted.

4) Example of Determining Switching by Length of Paper Tube

Figure 9:
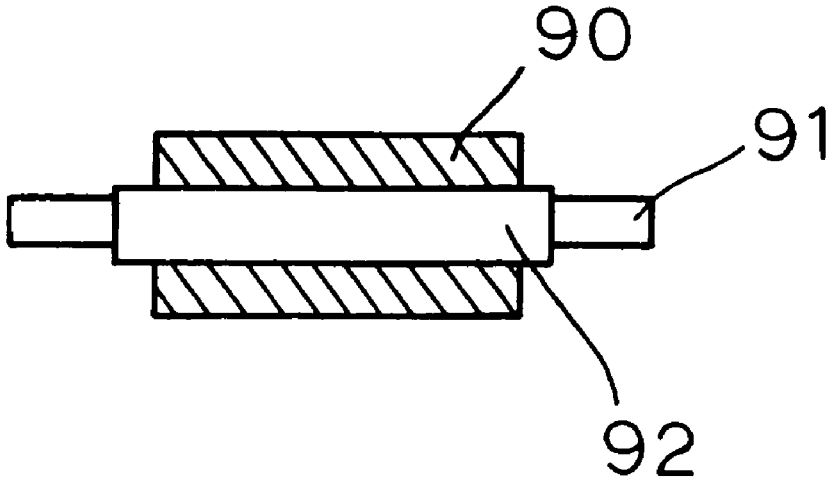
FIG. 9 is a view showing an example of a method of sensing switching of the labels in the printer of the present invention.
Figure 10:
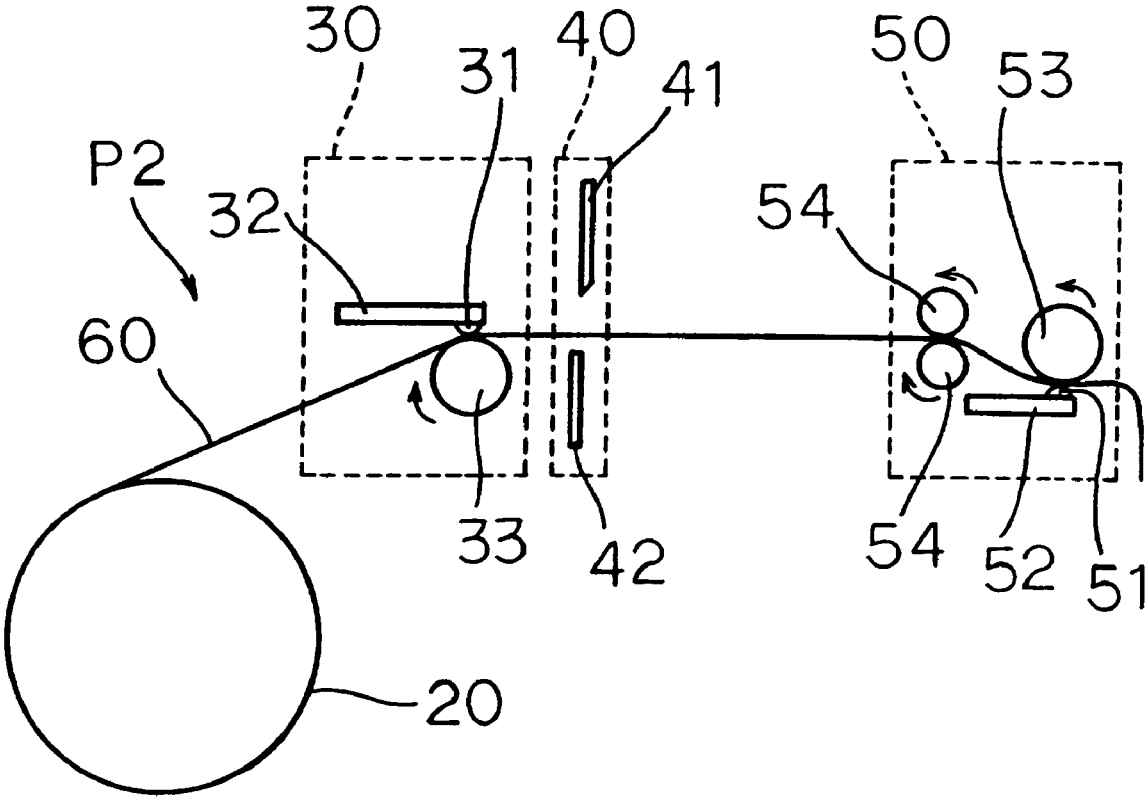
FIG. 10 is a view showing a general configuration of a printer capable of recording on a heat-sensitive adhesive sheet.

In contrast to the paper tube for the ordinary label, as shown in FIG. 9, both ends or one end of a paper tube having roll paper 90 of a heat-sensitive adhesive label wound therearound is made to protrude from the roll paper 92, and when a support shaft 91 of the paper tube 92 is attached to a holder of the roll housing unit 20, the end of the paper tube 92 is brought into contact with a switch provided on the holder, thus transmitting the above-described switching signal.

5) Example of Determining Switching by Holder Position of Support Shaft of Paper Tube In the same holder of the roll housing unit 20, which is attached to the support shaft of the paper tube having the roll paper wound therearound, the position to which the support shaft is attached is made different between the heat-sensitive adhesive label and the ordinary label, and a switch is provided on the bearing of the support shaft of the heat-sensitive adhesive label, thus transmitting the above-described switching signal. The above arrangement is also applicable when the holders for the support shafts of the heat-sensitive adhesive label and the ordinary label are provided separately from and adjacent to each other.

6) Example of Determining Switching by Color of Support Shaft of Paper Tube

The support shaft of the ordinary label and the support shaft of the heat-sensitive adhesive label are painted in different colors. By optically identifying the color of a support shaft when attaching the support shaft to the holder of the roll housing unit 20, or as the support shaft pushes a switch provided on the bearing, the above-described switching signal is transmitted.

7) Example of Determining Switching by Difference in Paper Width between Label Papers Comparing the ordinary label and the heat-sensitive adhesive label with each other, if the two labels have the same shape, the ordinary label has a larger paper width because the ordinary label is stuck onto the release paper (liner). Such a difference in paper width due to whether or not this liner exists is sensed by a mechanical or optical sensor, thus transmitting the above-described switching signal.

8) Example of Determining Switching by Difference in Paper Quality between Label Papers The ordinary label is stuck onto the release paper (liner), and the heat-sensitive adhesive label does not have the liner and the like. Accordingly, between the ordinary label and the heat-sensitive adhesive label, there occur a difference in color between front and rear sides and a difference in reflectivity. Such differences are sensed by a mechanical or optical sensor, thus transmitting the above-described switching signal.

9) Example of Determining Switching by Difference in Paper Thickness between Label Papers Due to the above-mentioned presence/absence of the liner, a difference in paper thickness occurs between the ordinary label and the heat-sensitive adhesive label. For example, the paper thickness of the ordinary label including the release paper ranges from 110 μm to 150 μm, and the paper thickness of the heat-sensitive adhesive label ranges from 80 to 120 μm. Hence, such a difference in paper thickness due to the presence/absence of the liner is sensed by a mechanical or optical sensor, thus transmitting the above-described switching signal.

10) Example of Determining Switching Depending on Whether or Not Step Exists on Label Paper The ordinary label exhibits a step-wise change in label thickness because the ordinary label is stuck onto the liner. Meanwhile, there is no such step-wise change in thickness in the heat-sensitive adhesive label. Hence, whether or not there is such a step-wise change in thickness is sensed by a mechanical or optical sensor, thus transmitting the above-described switching signal.

11) Example of Determining Switching by Shape of Black Mark on Label

For paper alignment, a black mark is printed on the label in many cases. In view of this, the shape of such a black mark is made to differ between the ordinary label and the heat-sensitive adhesive label, and a difference in signal output by a PI sensor in accordance with such a difference in black mark shape is sensed, thus transmitting the above-described switching signal.

12) Example of Determining Switching by Pattern of Black Mark on Label

For the black mark pattern, single and continuous (double-stage and triple-stage) patterns are used, the pattern of the black mark is made to differ between the ordinary label and the heat-sensitive adhesive label, and a difference in signal by a PI sensor in accordance with the difference in pattern is sensed, thus transmitting the above-described switching signal.

13) Example of Determining Switching by Position of Black Mark on Label

Separately from the black mark for the paper alignment during transport, a black mark for recognizing the heat-sensitive adhesive label is formed, and a signal by a PI sensor dedicated for the black mark for recognizing the heat-sensitive adhesive label is sensed, thus transmitting the above-described switching signal.

14) Example of Switching by Operation Panel Switch of Printer

A switch provided on an operation panel unit of the printer is switched on and off, thus transmitting the above-described switching signal.

15) Example of Switching by Switch on Printer Body Side

A switch provided on a part of the printer body is switched on and off, thus transmitting the above-described switching signal.

16) Example of Switching on Operation Screen on Printer Side

A mode on an operation screen and an output mode (type of label and the like), which are registered in the control unit of the printer in advance, are selected, thus transmitting the above-described switching signal.

While the embodiment of the present invention has been specifically described above, the present invention is not limited to the above-described embodiment, and various alterations are possible without departing from the gist of the present invention.

For example, in the above-described embodiment, the description is directed to the case in which the present invention is applied to the printing apparatus of a thermosensitive system, such as the thermal printer. However, it is also possible to apply the present invention to printing apparatuses of a thermal transfer system, an ink-jet system, a laser print system, and the like. In such cases, labels in which processing suitable for the respective printing systems is made on the printable layers of the labels instead of the thermal printing layer will be used.

As described above, according to the present invention, both of the heat-sensitive adhesive label and the ordinary label become usable in one printer, and it is not necessary to manufacture machines dedicated for the respective labels, thus making it possible to reduce a capital investment when manufacturing the printer. Furthermore, as compared with the case of preparing the machines respectively dedicated for the heat-sensitive adhesive label and the ordinary label, expenses for installation and management of the printer can be reduced, thus making it possible to utilize an installation space efficiently.

Moreover, it can be detected by the switching signal whether the thermal label is used or the ordinary label is used, and accordingly, an error is eliminated from the printer operation to be performed in accordance with the label used, thus providing safety and security.

What is claimed is:

1. A printer for selectively printing on continuous heat-sensitive adhesive sheets and ordinary continuous sheets that have no heat-sensitive adhesive, the printer comprising:

a printing unit having printing means for printing on one surface of a continuous sheet and first transporting means for transporting the continuous sheet in a forward direction;

a cutter unit disposed downstream of the printing unit and that cuts the printed continuous sheet to a predetermined length;

a thermal activation unit disposed downstream of the cutter unit and having heating means for heating the other surface of the continuous sheet and second transporting means for transporting the continuous sheet in the forward direction;

means defining a storage space between the cutter unit and the thermal activation unit in which a length of the continuous sheet can be temporarily accumulated;

detecting means for detecting whether the sheet is a continuous heat-sensitive adhesive sheet or an ordinary continuous sheet; and control means for controlling operation of the thermal activation unit so that both the heating means and the second transporting means are operated in response to detection of the continuous heat-sensitive adhesive sheet and so that the second transporting means but not the heating means is operated in response to detection of the ordinary continuous sheet.

2. A printer according to claim 1; wherein when the detecting means detects a continuous heat-sensitive adhesive sheet, the control means sets the transport speed of the first transporting means faster than that of the second transporting means to accumulate the continuous sheet in the storage space, and then stops operation of the printing means and the first transporting means while continuing operation of the heating means and the second transporting means to cut the continuous sheet by the cutter unit.

3. A printer according to claim 2; wherein when the detecting means detects an ordinary continuous sheet, the control means sets the transport speed of the first transporting means equal to that of the second transporting means, stops operation of the heating means, operates the printing means and the first and second transporting means to transport the continuous sheet, and then stops operation of the first and second transporting means to cut the continuous sheet by the cutter unit.

4. A printer according to claim 1; wherein when the detecting means detects an ordinary sheet, the control means sets the transport speed of the first transporting means equal to that of the second transporting means, stops operation of the heating means, operates the printing means and the first and second transporting means to transport the sheet, and then stops operation of the first and second transporting means to cut the sheet by the cutter unit.

5. A printer according to claim 1; wherein the second transporting means comprises a platen roller opposed to and resiliently pressed toward the heating means; and wherein the control means sets the pressing force with which the platen roller is pressed toward the heating means smaller during transporting of an ordinary continuous sheet than during transporting of a continuous heat-sensitive adhesive sheet.

6. A printer according to claim 5; wherein when the detecting means detects a continuous heat-sensitive adhesive sheet, the control means sets the transport speed of the first transporting means faster than that of the second transporting means to accumulate the continuous sheet in the storage space, and then stops operation of the printing means and the first transporting means while continuing operation of the heating means and the second transporting means to cut the continuous sheet by the cutter unit.

7. A printer according to claim 6; wherein when the detecting means detects an ordinary continuous sheet, the control means sets the transport speed of the first transporting means equal to that of the second transporting means, stops operation of the heating means, operates the printing means and the first and second transporting means to transport the continuous sheet, and then stops operation of the first and second transporting means to cut the continuous sheet by the cutter unit.

8. A printer according to claim 7; wherein the detecting means detects whether the sheet is a continuous heat-sensitive adhesive sheet or an ordinary continuous sheet based on one of (a) a configuration of the continuous sheet, (b) a configuration of a tube on which the continuous sheet is wound, (c) a configuration of a support shaft that supports a tube on which the continuous sheet is wound, (d) a position of a holder to which is attached a support shaft that supports a tube on which the continuous sheet is wound, (e) a mark on the continuous sheet, (f) switching of a switch, and (g) input data.

9. A printer according to claim 1; wherein the detecting means detects whether the continuous sheet is a continuous heat-sensitive adhesive sheet or an ordinary continuous sheet based on a configuration of the continuous sheet.

10. A printer according to claim 1; wherein the detecting means detects whether the continuous sheet is a continuous heat-sensitive adhesive sheet or an ordinary continuous sheet based on a configuration of a tube on which the continuous sheet is would.

11. A printer according to claim 1; wherein the detecting means detects whether the continuous sheet is a continuous heat-sensitive adhesive sheet or an ordinary continuous sheet based on a configuration of a support shaft that supports a tube on which the continuous sheet is wound.

12. A printer according to claim 1; wherein the detecting means detects whether the continuous sheet is a continuous heat-sensitive adhesive sheet or an ordinary continuous sheet based on a position of a holder to which is attached a support shaft that supports a tube on which the continuous sheet is wound.

13. A printer according to claim 1; wherein the detecting means detects whether the sheet is a continuous heat-sensitive adhesive sheet or an ordinary continuous sheet based on a mark on the sheet.

14. A printer according to claim 1; wherein the detecting means detects whether the continuous sheet is a continuous heat-sensitive adhesive sheet or an ordinary continuous sheet based on switching of a switch.

15. A printer according to claim 1; wherein the detecting means detects whether the continuous sheet is a continuous heat-sensitive adhesive sheet or an ordinary continuous sheet based on input data.

16. A printer according to claim 1; wherein the detecting means produces a switching signal indicative of whether the continuous sheet is a continuous heat-sensitive adhesive sheet or an ordinary continuous sheet; and further including a switching signal receiving unit that receives the switching signal and inputs it to the control means.

17. A printer comprising:

a printing device having printing means for performing printing on one surface of a continuous sheet and first transporting means for transporting the continuous sheet in a predetermined direction;

a cutter device which is provided downstream of the printing device and cuts the continuous sheet into a predetermined length;

a thermal activation device which is provided downstream of the cutter device and has heating means for heating the other surface of the continuous sheet and second transporting means for transporting the continuous sheet in the predetermined direction;

a space portion which is provided between the cutter device and the thermal activation device and where the continuous sheet can be warped by a predetermined length;

a control device which controls the printing device, the cutter device, and the thermal activation device differently between a case where the continuous sheet is a heat-sensitive adhesive label in which a printable layer is formed on one surface of a sheet-like base material and a heat-sensitive adhesive layer is formed on the other surface of the sheet-like base material and a case where the continuous sheet is an ordinary label in which a printable layer is formed on one surface of a label base material, a heat-sensitive adhesive layer is formed on the other surface of the label base material, and the label base material is stuck onto tape-like release paper; and a switching signal receiving unit that receives a switching signal for switching from a control condition for the ordinary continuous label to a control condition for the continuous heat-sensitive adhesive label, the switching signal being transmitted based on one of (a) a configuration of the tape-like sheet, (b) a configuration of a tube having the continuous sheet wound therearound in a roll shape, (c) a configuration of a support shaft which supports the tube, (d) a position of a holder to which the support shaft is attached, (e) a black mark on the continuous sheet, (f) switching of a switch, and (g) input data, wherein, based on the switching signal, when the continuous sheet is the heat-sensitive adhesive label, the control device sets the transport speed of the first transporting means faster than a transport speed of the second transporting means to warp the continuous heat-sensitive adhesive sheet by a predetermined length between the cutter device and the thermal activation device, and then stops operations of the printing means and the first transportation means while continuing operations of the heating means and the second transporting means to cut the heat-sensitive adhesive label by the cutter device, and when the continuous sheet is the ordinary continuous label, the control device sets the transport speed of the first transporting means and the transport speed of the second transporting means equal to each other, stops operation of the heating means, operates the printing means and the first and second transporting means to transport the ordinary label, and stops operations of the first and second transporting means to cut the ordinary label by the cutting device.

18. A printer according to claim 17; wherein in a case of the ordinary continuous label, when the label is not to be cut one by one, the control device controls the cutter device to operate only at a time when printing on the last label is completed.

19. A printer according to claim 17; wherein the first transporting means comprises a printing platen roller opposed to the printing means, and the second transporting means comprises a thermal activation platen roller opposed to the heating means, and wherein a pressing force with which the thermal activation platen roller is pressed toward the heating means during transporting of the ordinary label is set smaller than a pressing force applied during transporting of the continuous heat-sensitive adhesive label.

20. A printer according to claim 17; wherein the printer switches a setting for the pressing force, with which the thermal activation platen roller is pressed toward the heating means, upon receiving the switching signal.

* * * * *